US005974688A

United States Patent [19]

Domingue et al.

[11] Patent Number: 5,974,688

[45] Date of Patent: Nov. 2, 1999

[54] APPARATUS FOR CONTROLLED DRYING OF SLUDGE

[75] Inventors: Hille Domingue; James A. Martin, both of Lafayette, La.

[73] Assignee: Sludge Drying Systems, Inc., Lafayette, La.

[21] Appl. No.: 08/954,503

[22] Filed: Oct. 20, 1997

Related U.S. Application Data

[62] Division of application No. 08/548,292, Nov. 1, 1995, Pat. No. 5,678,323.

[51] Int. Cl.[6] ..... F26B 3/34

[52] U.S. Cl. ..... 34/269; 34/586; 34/589; 34/135; 34/173; 34/180

[58] Field of Search ..... 34/266, 268, 269, 34/209, 418, 423, 424, 528, 550, 576, 580, 586, 589, 135, 147, 173, 180; 110/225, 238, 244, 346; 210/194, 201, 218, 220, 770; 219/685, 701, 705, 710

[56] References Cited

U.S. PATENT DOCUMENTS

| | | | |
|---|---|---|---|
| 2,981,528 | 4/1961 | Culp . | |
| 3,367,038 | 2/1968 | Bishop, Sr. . | |
| 3,850,224 | 11/1974 | Vidmar et al. . | |
| 4,170,073 | 10/1979 | Ignatowicz | 34/495 |
| 4,453,474 | 6/1984 | Lewis | 110/346 X |
| 4,472,887 | 9/1984 | Avedian et al. . | |
| 5,245,762 | 9/1993 | Hartis et al. | 34/402 |
| 5,309,827 | 5/1994 | Manser et al. . | |
| 5,357,881 | 10/1994 | Elcik et al. | 110/346 |
| 5,497,562 | 3/1996 | Pikus | 34/269 |

*Primary Examiner*—Henry A. Bennett
*Assistant Examiner*—Steve Gravini

[57] ABSTRACT

A method and drying apparatus for drying a quantity of sludge. The drying apparatus is comprised essentially of a plurality of drying zones; a plurality of infrared emitters within each of the drying zones; a means for producing a flow of the sludge through the drying zones; a control means; means for determining and transmitting to the control means control input signals indicating the temperature of the infrared emitters within each of the drying zones; means for determining and transmitting to the control means control input signals indicating the temperature of the sludge within each of the drying zones; means for determining and transmitting to the control means control input signals indicating the wet bulb temperature of the air within each of the drying zones; means for determining and transmitting the temperature of the metal components of the dryer; means for determining and transmitting to the control means control input signals indicating an interruption and uninterruption of the sludge flow through the dryer; and processor means having a predetermined set of signal set points incorporated with the control means. The processor means is for receiving the control input signals from the drying apparatus, comparing the input signals to each other and to the predetermined set of signal set points and for transmitting control output signals based upon the control input signals and the predetermined set of signal set points to independently regulate the temperature of the heating elements within each of the drying zones to control the drying of the sludge.

8 Claims, 7 Drawing Sheets

FLOW CHART OF CONTROLS FOR DRYER

1. TEMPERATURE CONTROLS FOR EACH HEATING ZONE

APPARATUS FOR CONTROLLED DRYING OF SLUDGE

This is a division of application Ser. No. 08/548,292 filed Nov. 1, 1995, now U.S. Pat. No. 5,678,323.

FIELD OF INVENTION

The present invention generally relates to the field of drying wastewater and industrial sludges, and more particularly, relates to a method and improved dryer apparatus for controlled drying of sludges with radiant energy to optimize sludge drying time and minimize the risk of sludge combustion and harmful dryer expansion.

BACKGROUND OF INVENTION

In the field of municipal and industrial wastewater disposal it is necessary to treat the resulting wastewater sludge by heating to reduce the sludge volume by reducing its water content by evaporation and to reduce the sludge borne pathogens and its potential for vector attraction. Thermal drying of these sludges has emerged as one of the preferred treatment methods. Thermal drying typically constitutes passing sludge with a high water content through a dryer by means of a conveyor where heat may be applied to the sludge along the conveyor to increase the sludge temperature so as to reduce the water content to a desired level.

Thermal drying takes place by transferring heat energy to the sludge to elevate the sludge temperature and evaporate the water. The transfer of heat energy may be accomplished by either conduction, convection or radiation. Of the three, radiation produced by infrared heaters is the most energy efficient as it results in lower heat losses during the transfer and, when compared to forced air convection heating, a substantially smaller air emission control system.

One of the problems associated with thermal drying of organic sludges is that during drying, as the water content of the sludge decreases and the sludge solids content increases, and if energy is transferred to the sludge at the same rate, sludge combustion is likely to occur. This autogenous stage for sludge combustion typically takes place when the solids content of the sludge reaches 35 percent or above.

Sludge combustion during thermal drying is a widespread safety and operational problem which must be resolved. Generally, combustion is controlled by reducing the temperature applied to the sludge within the dryer. However, a reduction in dryer temperature results in a slower sludge drying time and a corresponding reduction in drying efficiency. A problem heretofore associated with sludge drying has been the need to balance the risk of sludge combustion during drying with the need to provide energy efficient and economical sludge drying.

Further, since sludge is typically dried in sludge dryers that are comprised of metal components, another problem associated with thermal drying is overheating the dryer's metal components. While dryers are typically designed to compensate for certain levels of heat expansion and for decreased metal strength due to elevated temperatures, if the design temperatures are exceeded by a substantial amount or for a prolonged period of time, excessive expansion and metal fatigue may cause permanent damage to the sludge dryer. Consequently, it is thought that it would be prudent to not only monitor and regulate the temperature of the sludge being dried to avoid sludge combustion but also to monitor and regulate the temperature of the metal components of the sludge dryer during the drying process.

Thermal drying systems sometimes utilize different drying zones where the temperature and humidity within each zone is controlled at predetermined levels to regulate the rate of moisture content reduction of the material being dried. This concept is illustrated in U.S. Pat. No. 5,309,827 to Manser et al for a pasta dryer which illustrates the concept of different "climate" zones at various stages of the drying process. Other materials dryers which incorporate different drying chambers or zones to control the drying process include those illustrated in U.S. Pat. No. 4,472,887 to Avedian et al, U.S. Pat. No. 3,850,224 to Vidmar et al, and U.S. Pat. No. 2,981,528 to Culp. Still another dryer for controlling the moisture content of crumb rubber by monitoring the rubber temperature and the dryer air temperature at different zones in the dryer as a means for regulating the zone air temperature was disclosed in U.S. Pat. No. 3,367,038 to Bishop. Sr.

None of these referenced dryers are directed toward a dryer and a dryer control apparatus that will monitor and regulate not only the temperature of the material being dried but also monitor and regulate the temperature of the dryer itself. Such a monitoring system would allow the material drying efficiency of the dryer to be maximized and at the same time reduce the risk of occurrence of combustion and damage to the dryer and its components due to temperature induced expansion and fatigue.

SUMMARY OF INVENTION

The present invention provides an apparatus and method designed to satisfy the aforementioned needs. It describes a sludge dryer having infrared heating elements or emitters and a dryer control method to maximize the radiant energy being transferred to the sludge being dried and, at the same time, minimize the possibility of sludge combustion during the drying process as well as minimize the risk of damage to the dryer itself due to excessive heat expansion and fatigue.

For dryers utilizing infrared emitters, the rate of radiant energy transfer to the sludge is dependent upon several factors which include the rate at which the product being dried absorbs the infrared waves, the size of the infrared wavelengths, and the net energy radiated by the infrared emitters. Each of these factors is directly affected by the surface temperature of the infrared emitter.

It is generally recognized that the absorption rate of radiant energy by a product being dried not only depends upon the product itself but also upon the magnitude of the infrared wavelength to which the product is exposed. Generally, for municipal wastewater sludges, infrared wavelengths ranging in size between 2.5 to 3.5 microns and 5.5 to 7.5 microns produce the best radiant energy absorption rate. However, as the sludge is being dried it begins to increase in temperature and thus begins to radiate energy itself. Consequently, the energy absorbed by the sludge is the difference between the energy radiated to the sludge by the emitters and the energy radiated back from the sludge as it dries.

At infrared wavelengths of a size between 2.5 to 3.5 microns, the net radiated energy absorbed by municipal wastewater sludges is roughly in the range between 10,000 and 30,000 btus per square foot per hour. To produce wavelengths in that range an infrared emitter must have a surface temperature between 1100 and 1600 degrees Fahrenheit. At infrared wavelengths of a size between 5.5 to 7.5 microns, the net energy radiated is roughly between 400 and 3,000 btus per square foot per hour. To produce wavelengths in this range, the surface temperature of the infrared emitter must be between 250 and 600 degrees Fahrenheit.

The lower the net energy radiated, the longer it takes to heat the sludge to evaporate the water. Processing sludge at the higher wavelengths, i.e., those in the 5.5 to 7.5 micron range, and at lower emitter temperatures increases the time the sludge must be retained in the dryer to produce the desired water content. Thus, the output volume of processed sludge at these lower emitter temperatures and higher infrared wavelengths can be increased only by increasing the size of the dryer.

To maximize the radiant energy transfer rate to the sludge, and thus minimize the sludge drying time, it is necessary to produce wavelengths in the 2.5 to 3.5 micron range. This can be done by maintaining the surface temperature of the infrared emitters between 1100 and 1600 degrees Fahrenheit. It is an object of this invention to produce a sludge drying process control system to maintain the surface temperature of the infrared emitters in that range.

Sludge dries in essentially three stages. During the first stage the sludge is warmed from its ambient temperature to the temperature at which water begins to evaporate from the sludge. During the second stage, known as the "steady state" stage, the free water in the sludge is evaporated. In the steady state stage, the temperature of the sludge does not exceed the wet bulb temperature of the air in the dryer. During the third stage, when the water from the sludge is evaporated, the temperature of the sludge begins to rise to the temperature of its surroundings.

Once sludge reaches a certain temperature during the drying process, usually when the solids content of the sludge reaches 35 percent or above, combustion begins to occur. If energy is continued to be applied to the sludge, a full fledged fire will occur. The combustion temperature of sludge varies and depends in large part upon the makeup and type of sludge being dried. Testing is necessary to determine the combustion temperature of a particular sludge type.

To control sludge combustion during drying, it is necessary to monitor and regulate the temperature of the sludge by controlling the amount of energy transferred to the sludge at different stages of the drying process. The wet bulb temperature of the air in the dryer is thought to be an accurate indicator of the temperature of the sludge in the dryer. It is therefore an object of this invention to monitor the wet bulb temperature of the air in the dryer as well as the temperature of the sludge being dried to determine when the sludge has entered the third stage of the drying process and to reduce the net radiated energy being applied to the sludge at that time so as to maintain the sludge temperature below its combustion temperature.

Typically, sludge dryers have conveyors, frame work and support structure made of metal. The dryers are designed to provide for a certain level of heat expansion and associated decrease in metal strength as temperatures increase during the drying process. If the design temperatures are exceeded for a prolonged period of time, excessive heat expansion and/or metal fatigue may occur. The risk of exceeding the design temperatures is present during the normal operation of most dryers, particularly when there is an interruption or stoppage of the flow of sludge to the dryer. Consequently, it is an object of the invention to monitor and control the temperature of the metal components of the dryer by reducing the net radiant energy being applied to the sludge so that the metal temperature does not exceed a predetermined maximum.

It is a further object of the invention to control the reduction of the net radiant energy being applied to the sludge in a situation where the desired metal temperature has been surpassed in such a fashion so as to allow the sludge already in the dryer to complete the drying process.

It is also an object of the present invention to provide a method of controlling a sludge dryer which includes the steps of monitoring the surface temperature of infrared emitters, the temperature of the sludge, the wet bulb temperature of the air within the dryer, the temperature of the metal, and the sludge flow to the dryer, simultaneously comparing these factors against each other and against a predetermined criteria so that each of the designated factors can be considered and accounted for in the sludge drying process.

It is still a further object of the present invention to provide a method of controlling a sludge dryer which includes the steps of independently monitoring the surface temperature of infrared emitters, the temperature of the sludge, the wet bulb temperature of the air within the dryer, and the temperature of the metal at selected locations within the dryer, as well as monitoring the sludge flow to the dryer, simultaneously comparing these factors against each other and against a predetermined criteria so that the each of the designated factors can be considered and accounted for in regulating the surface temperature of the infrared emitters, and thus the sludge being dried, during the sludge drying process.

DESCRIPTION OF THE PREFERRED EMBODIMENT

Figure 1:
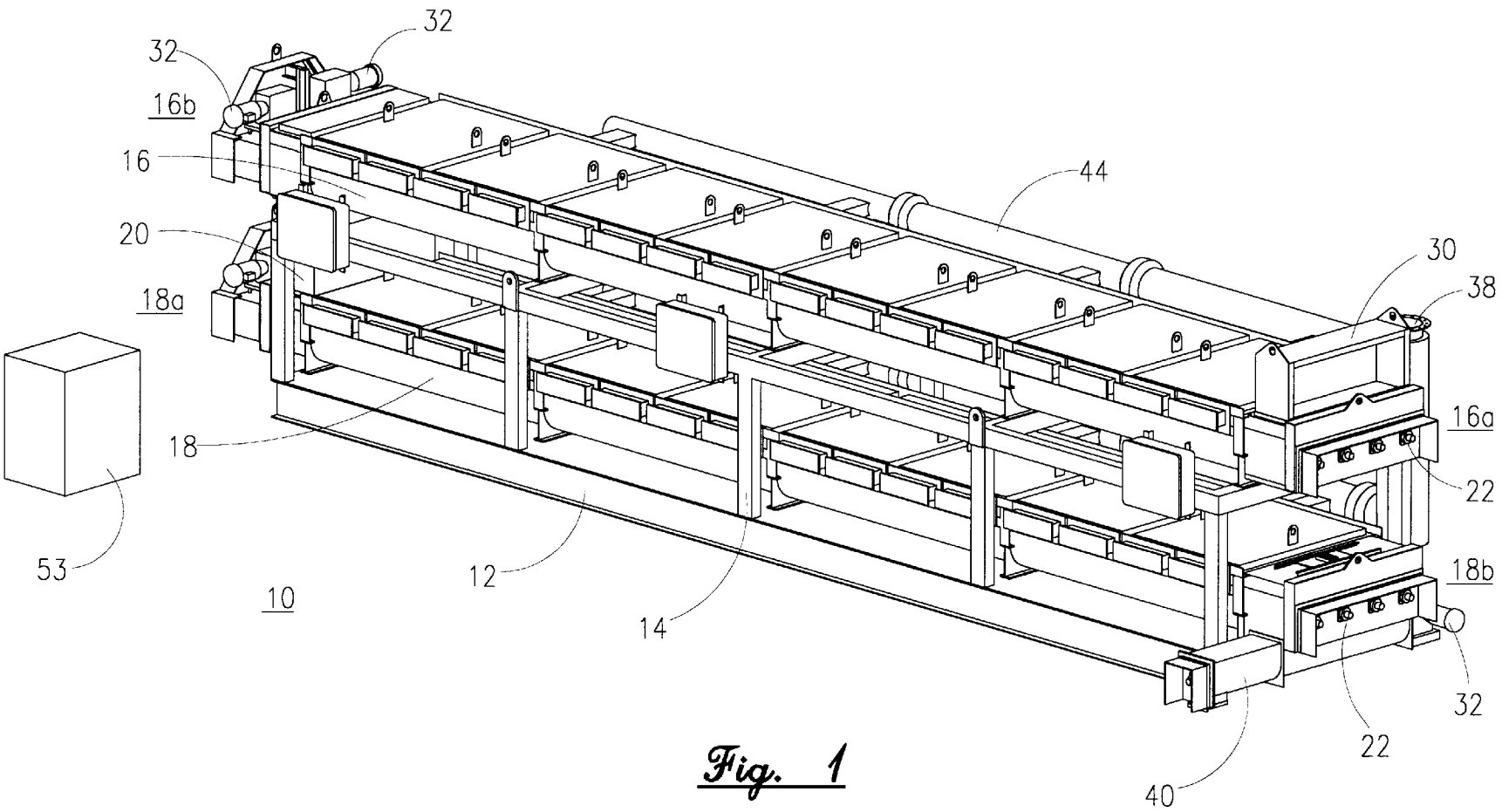
FIG. 1 is a perspective view of applicants' dryer.
Figure 2:
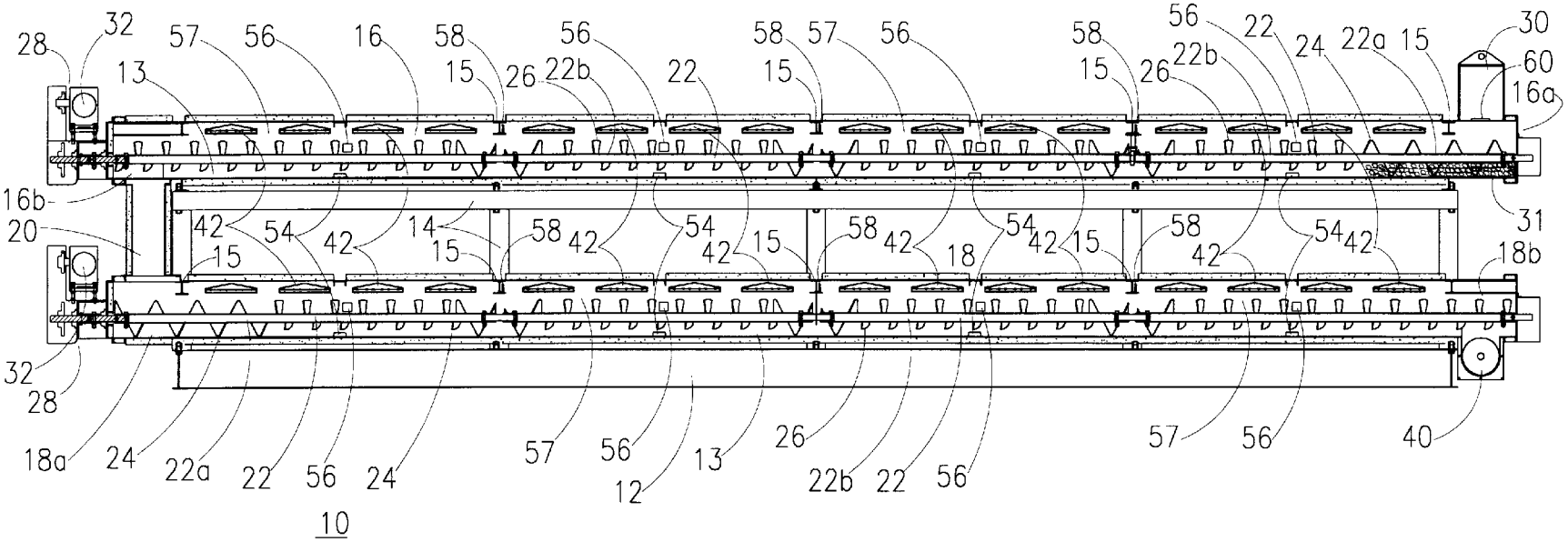
FIG. 2 is a longitudinal cross-sectional schematic view of FIG. 1.

Referring now to the drawings and more particularly to FIGS. 1 and 2, there is shown the preferred embodiment of applicants' invention. The sludge dryer 10 is supported on a rectangular metal skid 12 which in turn supports a rectangular welded steel framework 14. Mounted longitudinally within the framework 14 at its upper level is an upper auger trough assembly 16 having an inlet end 16*a* and an outlet end 16*b*. Directly below the upper auger trough assembly 16 there is shown a lower auger trough assembly 18 which is also supported within the framework 14. The lower auger trough assembly 18 has an inlet end 18*a*, which correspond to the outlet end 16*b* of the upper auger trough assembly 16, and an outlet end 18*b*.

A sludge inlet chute 30 is mounted to the framework 14 to allow sludge 31, such as municipal wastewater or an industrial sewage sludge, to be introduced into the upper auger trough assembly 16 at its inlet end 16*a*. The outlet end 16*b* of the upper auger trough assembly 16, which is at the end of the upper trough assembly 16 distal from the sludge inlet chute 30, is connected to the inlet end 18*a* of the lower auger trough assembly 18 by means of a sludge transfer chute 20.

Figure 6:
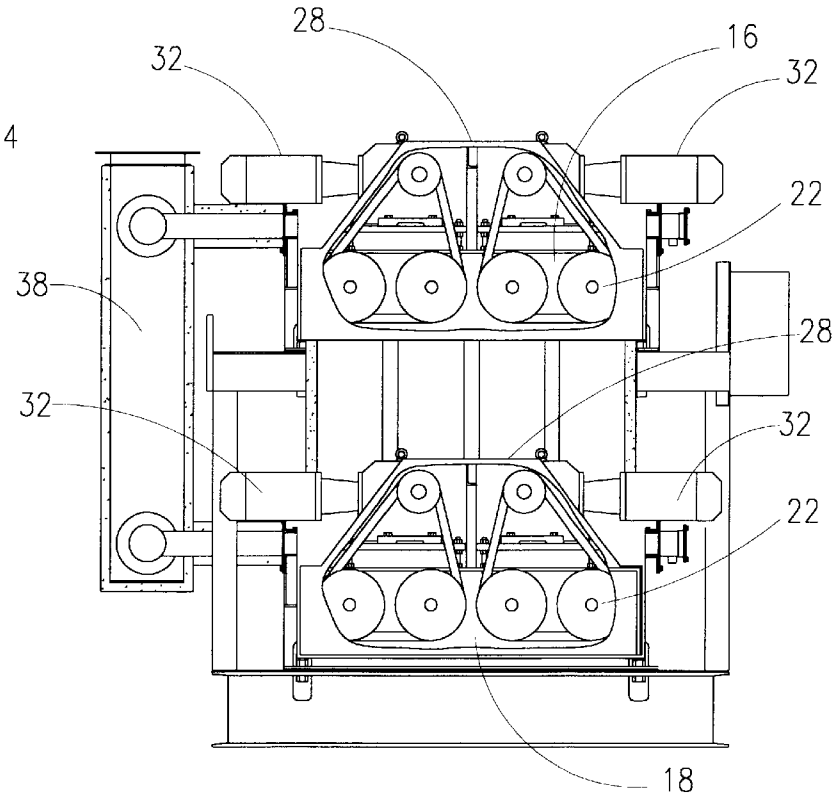
FIG. 6 is a cut-a-way end-view of FIG. 1 illustrating the auger drive assembly.

Rotatably mounted within each trough 13 of the upper auger trough assembly 16 and lower auger trough assembly 18 is an auger 22. Each auger 22 has a first section 22*a* comprised of a continuous auger screw 24 and a second section 22*b* comprised of a plurality of paddle blades 26. As shown in FIG. 6, each auger 22 of the auger trough assemblies 16 and 18 is rotated by an auger drive assembly 28 comprised of a plurality of chains and sprockets. In the preferred embodiment, each auger drive assembly 28 is powered by a plurality of electric motors 32 which are mounted to the auger trough assembly corresponding to the augers being turned adjacent to the outlet end 16*b* of the upper auger trough assembly 16 and the inlet end 18*a* of the lower auger trough assembly 18. Other means for powering the auger drive assemblies such as gasoline or diesel engines could also be utilized.

A sludge outlet chute 40 is connected to the lower auger trough assembly 18 at its outlet end 18*b* to discharge sludge 31 from the apparatus 10. Sludge 31 is introduced to the dryer 10 from the sludge inlet chute 30 to the inlet ends 16*a* of the upper auger trough assembly 16. As the augers 22 are turned, the sludge 31 is moved through the dryer 10 along the upper auger trough assembly 16 to its outlet end 16*b*, down the transfer chute 20, into the inlet end 18*a* of the lower auger trough assembly 18, then along the lower auger trough assembly 18 to its outlet end 18*b*, and then into a sludge outlet chute 40.

Also shown FIG. 1 is an emission collection assembly 38 having a ductwork assembly 44 which penetrates both the upper auger trough assembly 16 and the lower auger trough assembly 18. The emission collection assembly 38 collects the heated air and vapors produced from the drying sludge 31 as the sludge 31 is moved along the auger trough assembly 16 and 18 through the dryer 10. The air and vapors collected by the emission collection assembly is transferred to air scrubbers not shown.

Figure 3:
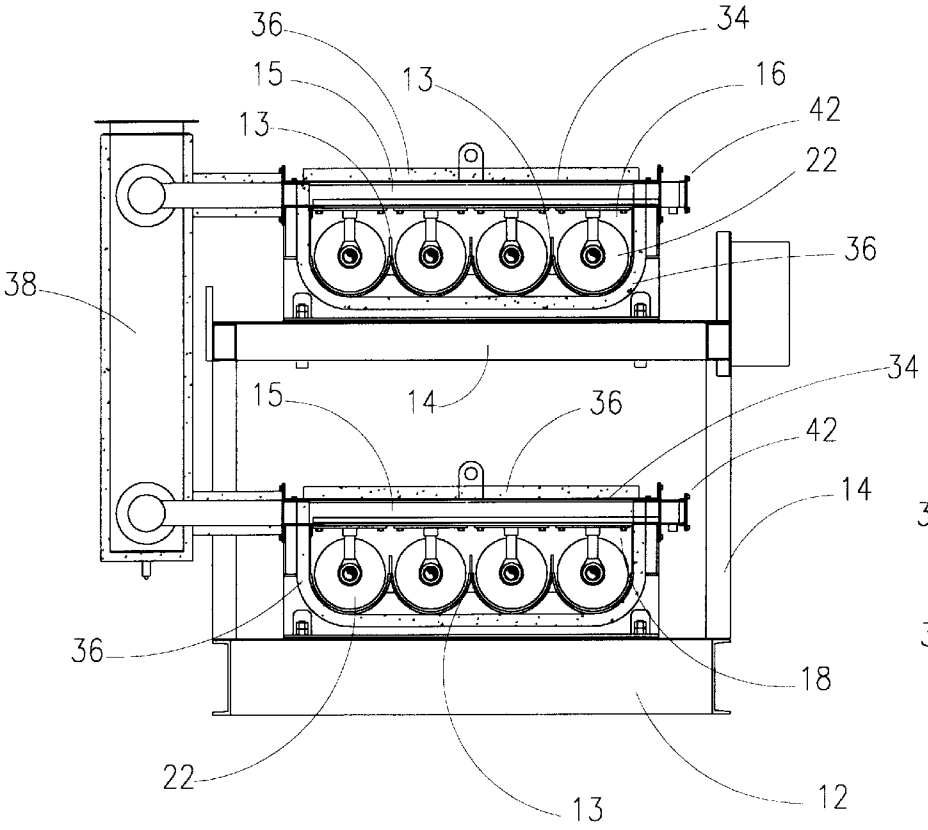
FIG. 3 is a transverse cross-sectional schematic view of FIG. 1 showing the each auger trough assembly.

As shown in FIG. 3, the auger trough assemblies 16 and 18 are comprised of a plurality of abutting metal troughs 13 welded together at their adjoining edges. The auger troughs 13 of each auger trough assembly, 16 and 18, are supported at their upper edges by a plurality of transverse beams 15. Each auger trough assembly, 16 and 18, is sealed across the top above the transverse beams 15 by trough top covers 34. Each auger trough assembly, 16 and 18, with cover 34 is covered on its outside by a blanket of insulation 36. Penetrating each auger trough assembly, 16 and 18, along its length, at positions below the top cover 34 and extending above and transverse to the augers 22, are a plurality of infrared heating assemblies 42 which are used to transmit radiant energy to the sludge 31.

Figure 4:
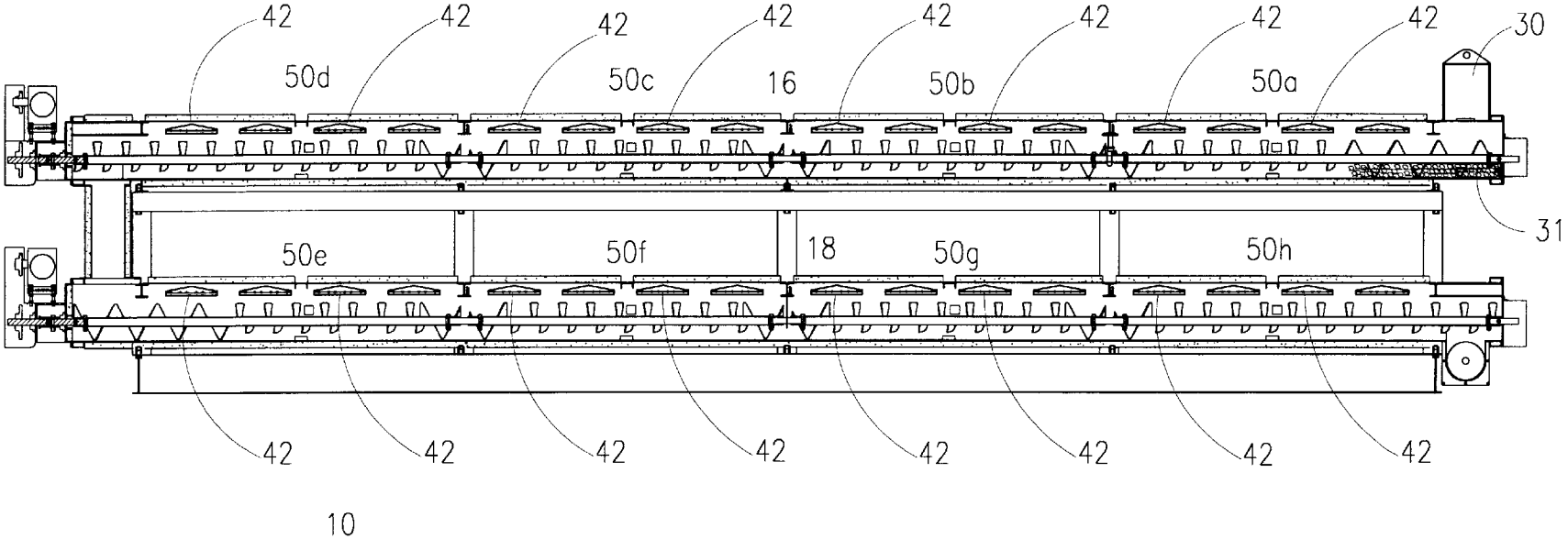
FIG. 4 is a longitudinal cross-sectional schematic view of applicants' dryer showing the heating and monitoring systems.

Referring now to FIG. 4, there is shown the auger trough assembly 16 and 18 divided into a plurality of heating zones 50, each heating zone designated individually as 50*a* through 50*h*. Within each heating zone 50, along the auger trough assembly 16 and 18, there is shown a plurality of infrared heating assemblies 42 each having a plurality of infrared heating elements 48. These heating elements 48 radiate infrared heat energy at variable and controllable levels to the sludge 31 as the sludge is moved along the auger trough assembly 16 and 18 by the augers 22 through each of the heating zones 50 of the dryer 10.

Figure 5:
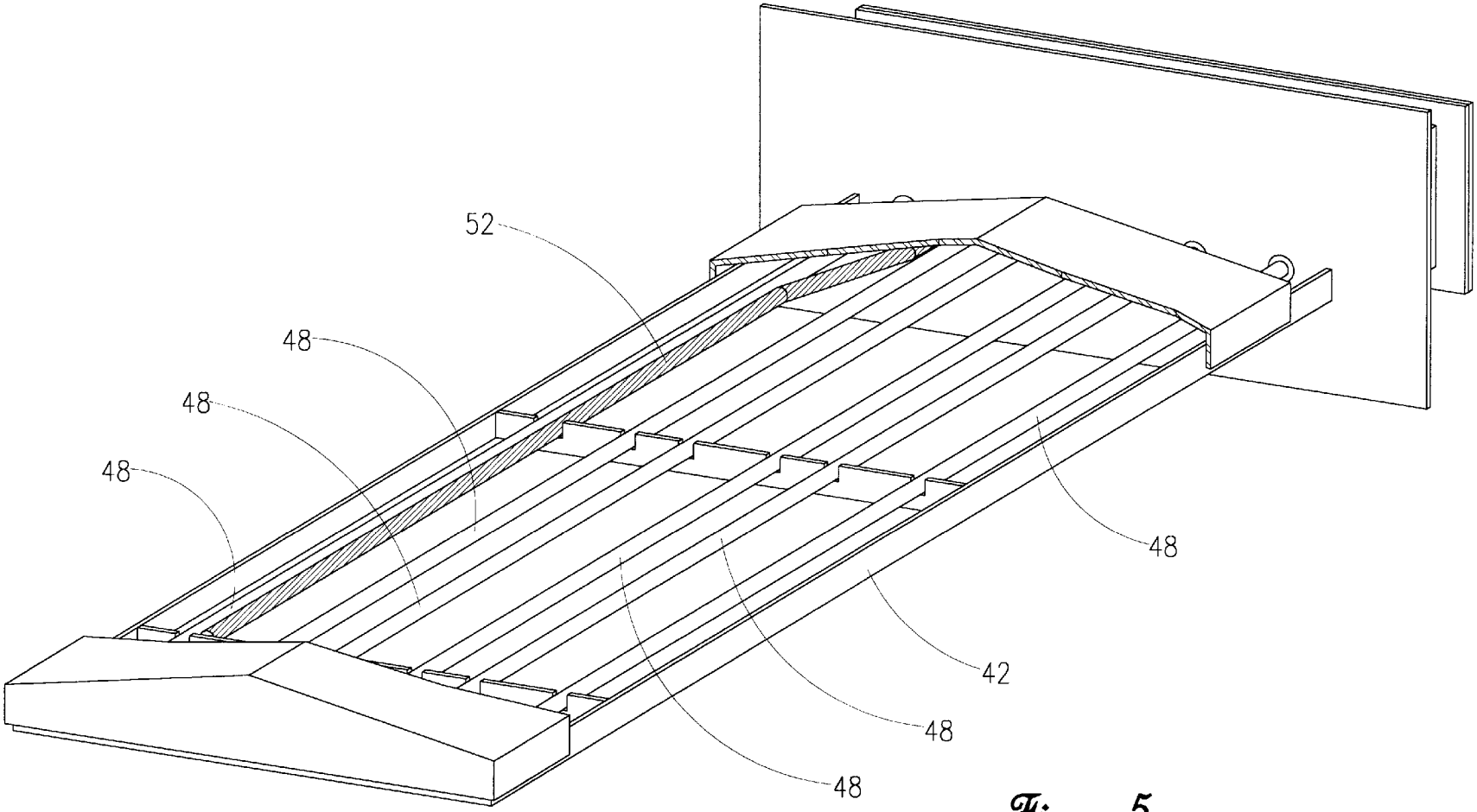
FIG. 5 is a schematic drawing of the infrared heating assemblies.

In the preferred embodiment, the heating assemblies 42, as shown schematically in FIG. 5, utilize electrically powered infrared heating elements 48, to emit radiant energy though other power supply means such as natural gas may also be utilized to power the heating elements. A selected heating assembly 42 within each zone 50 has a thermocouple 52 with leads connected to a control console 53, shown schematically in FIG. 7, which monitors the surface temperature of the heating elements 48. In the preferred embodiment, the thermocouples 52 used to monitor the surface temperature of the heating elements 48 are typically of the kind using type "K" wire mounted to the surface of each heating element 48, though other temperature sensing means could be utilized.

Also mounted within each heating zone 50 along each auger trough assembly, 16 and 18, are a plurality of infrared sensors 54, again with leads to the control console 53. The infrared sensors 54 continuously monitor the temperature of the sludge 31 at selected points within each of the heating zones, 50*a*–50*h*, as the sludge 31 is transferred along the auger trough assembly 16 and 18. Similarly, a plurality of humidity sensors 56, with leads to the control console 53, are mounted at selected points along each auger trough assembly, 16 and 18, to continuously monitor the wet bulb temperature of the air in the ullage or air space 57 of each auger trough assembly, 16 and 18, in each heating zone 50. In addition, a plurality of thermocouples 58 having leads to the control console 53 are positioned at the center of selected transverse beams 15 of each auger trough assembly, 16 and 18, to monitor the metal temperature of the transverse beams. Finally, a flow signal switch 60 with leads to the control console 53 is positioned at the sludge inlet chute 30. The flow signal switch 60 is activated by the sludge 31 entering the inlet chute 30 to signal to the control console 53 an interruption or continuation of the flow of sludge 31 into the dryer 10.

In the preferred embodiment, a continuous wet bulb monitoring device such as a humidity sensor 56 is used to monitor the wet bulb temperature of the air in the ullage or air space 57 in each heating zone 50. The temperature of the sludge 31 in each auger trough assembly, 16 and 18, is monitored using a non-contact infrared temperature sensor 54 with an air purge collar and cooling jacket mounted at the end of each heating zone 50 in such position as to have an optimum spot size or field of view. The temperature of the selected transverse beams 15 of each auger trough assembly, 16 and 18, is monitored with a base metal thermocouple using type "K" wire mounted on the transverse beams 15. However, other temperature sensors might be utilized to produce temperature input signals to the control console 53.

The control console 53 has a computerized processor designed to process simultaneously the various input signals from the thermocouples, the infrared sensors, the humidity sensors and the flow switch and to compare the various input temperature signals and input data signals to each other and to predetermined values. The control console 53 is programmed to select a predetermined dryer control output function based upon the input signals received from the various monitors and produce an output control signal to regulate the surface temperature of the heating elements 48 in each of the heating zones 50. As the input signals transmitted to the control console 53 change during the drying process, the importance of any particular input signal when compared to the other input signals being transmitted will vary. Having all of the signals processed simultaneously, allows the dryer control console 53 to regulate the temperature of the heating elements 48 in each of the heating zones 50 to optimize the drying of the sludge 31 for the various drying conditions encountered as the sludge 31 is moved through the dryer 10 to the sludge outlet chute 40.

The primary control input signal transmitted to the control console 53 will be the surface temperature of the various infrared heating elements 48. The predetermined temperature value or set point entered into the control console 53 for the surface temperature of the heating elements 48 will be that temperature which produces the maximum radiant heat transfer rate, as discussed above. Depending upon the particular characteristics of the sludge 31 being dried, the temperature set point will vary between 1100 degrees Fahrenheit and 1600 degrees Fahrenheit. For the typical municipal sewage sludge, a set point of around 1550 degrees Fahrenheit has been found to produce the best results.

The various input temperature signals are utilized to control the drying of the sludge 31. The control console 53 is designed to produce output signals which maintain the surface temperature of the heating element 48 at the set point value unless one or more of the other input signals exceeds its respective predetermined set point. If that occurs, the control console 53 will initiate an output signal to decrease the surface temperature of all or of selected heating elements 48 as the sludge 31 is moved through the heating zones 50 along the auger trough assembly 16 and 18.

If any of the input temperatures exceed a given set point established in the control console 53, the console 53 enters a loop designed to reduce the set point for the surface temperature of the heating elements 48 in a predetermined sequence based upon the extent by which any of the monitored temperatures exceeds its set point. The greater the variation of an actual temperature from its respective set point, the lower the set point established by the console 53 for the corresponding heating elements 48. When the monitored temperatures exceed their respective set points, the intent is to have the temperature of the heating elements 48 in the various heating zones 50 coincide with those temperatures that create infrared wavelengths that have a low absorption rate, and/or a low level of net radiated energy. Once any monitored temperature drops below its respective set point for a predetermined period of time or by a predetermined amount, the control console 53 returns the set point of the surface temperature of the heating elements 48 to the original primary setting.

In addition, the flow of sludge 31 into the dryer 10 is monitored by the sludge flow switch 60 which signals an interruption or stoppage of the sludge flow. This sludge flow signal is input into to the control console 53. After a predetermined delay, the control console 53 then initiates an output signal to set the surface temperature of the heating elements 48 to zero degrees Fahrenheit in each heating zone 50 at predetermined intervals and in a predetermined sequence. At these predetermined intervals the input signals from the flow switch 60 will override all other input signals. During the sequenced intervals, the console will provide controls to regulate the heating element temperatures in the same manner and in the same priority as outlined above. Maintaining these control intervals allows an orderly shutdown of the dryer when sludge flow is interrupted so as to allow the sludge 31 already in the dryer 10 to by cycled through the drying process.

Figure 8:
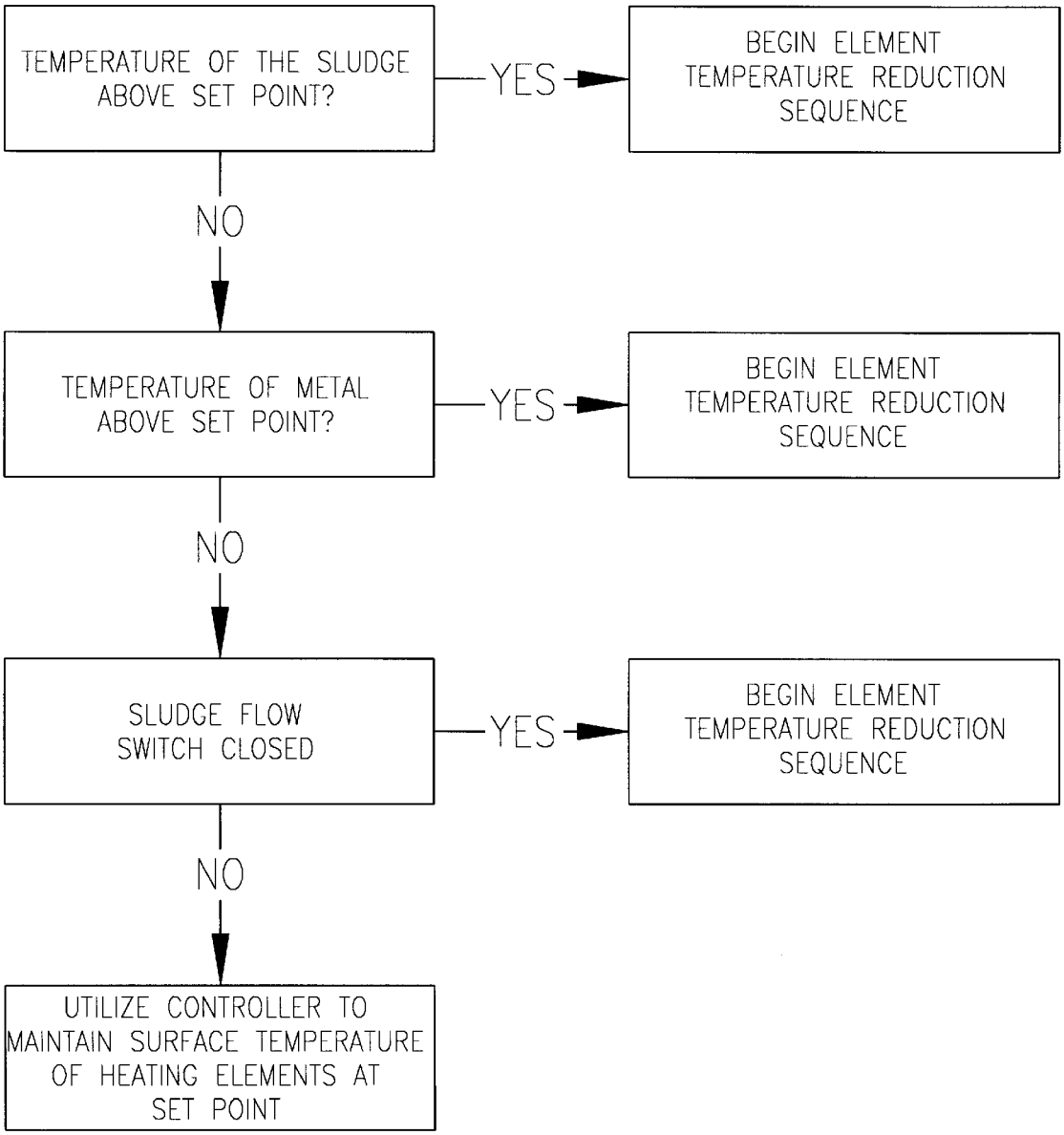
FIG. 8 is a flow chart showing the preferred dryer control sequence.

The preferred drying process control sequence for the control console 53 is shown in FIG. 8. The process control console 53 is designed to receive at least four process input signals for each of the heating zones 50. These input signals are the surface temperature of the selected infrared heating elements 48, the temperature of the sludge 31, the wet bulb temperature of the air within the ullage or air space 57 of each of the heating zones 50, the temperature of the selected metal transverse beams 15 of the auger trough assemblies 16 and 18. In addition the process control console is designed to receive the input signal indicating whether an interruption or stoppage of the flow of the sludge 31 to the dryer 10 has occurred. The input signals to the process control console 53 are monitored simultaneously to compare the input signals with each other as well as to predetermined programmed set points. Once the input signals are compared, the control console 53 responds to the input signals with a predetermined range of output options to regulate the surface temperature of the heating elements 48 in each heating zone 50, independent from the other heating zones 50. Various control output sequences may be established and utilized depending upon the type of sludge being dried and the drying parameters established by the user.

Figure 7:
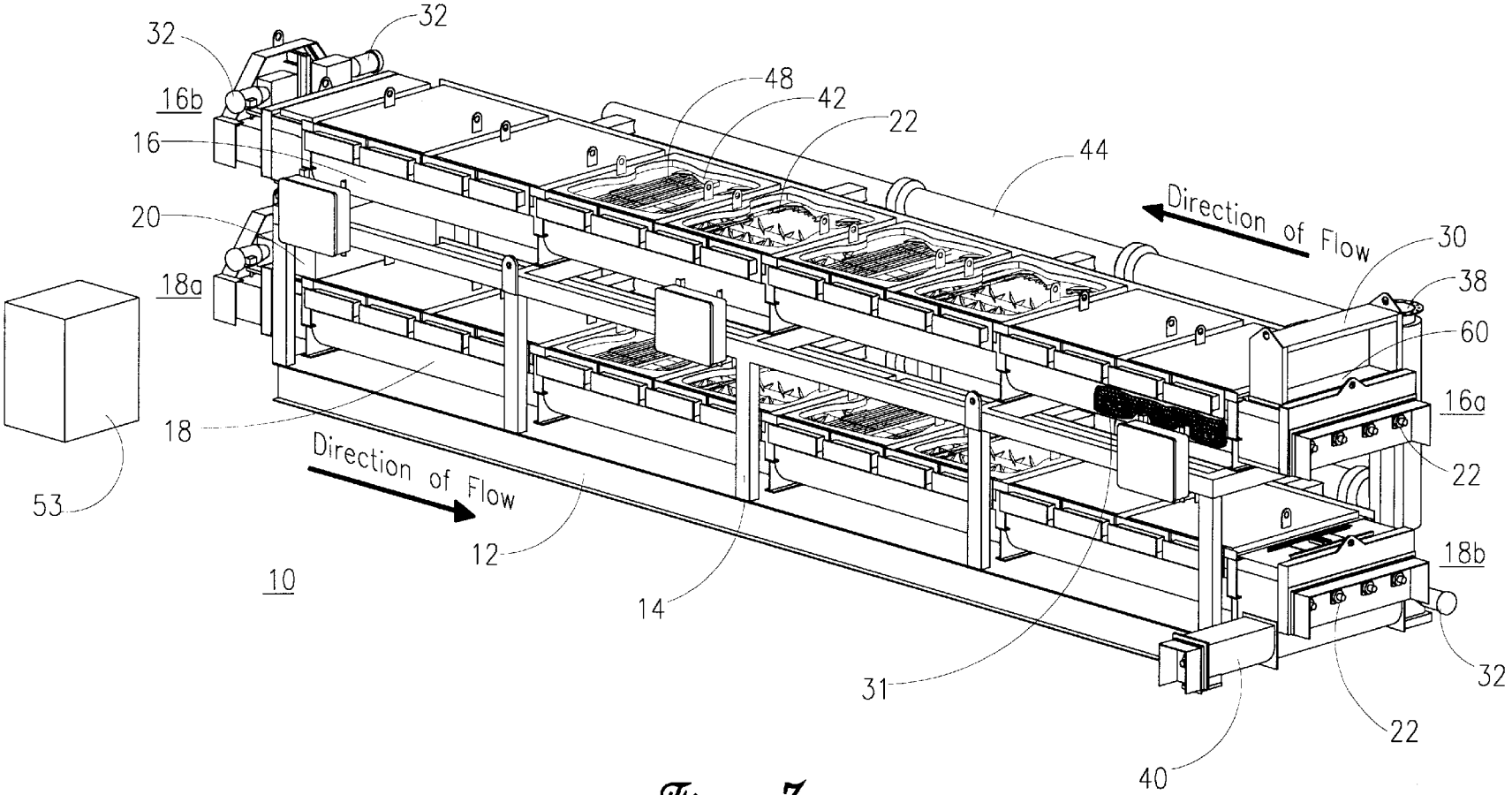
FIG. 7 is a cut-a-way perspective view of applicants' dryer showing the flow of sludge through the dryer.

Referring now to FIG. 7 and 8, as an example of the process, sludge 31 is introduced into the dryer 10 by means of the inlet chute 30. The sludge 31 then is transported through the dryer 10, along the auger trough assemblies 16 and 18, by means of the augers 22. As the sludge 31 moves along the auger trough assemblies, through each heating zone, 50*a*–50*h*, it is exposed to the radiant energy by being transmitted by the heating element assemblies 42. The process control console 53 monitors the input signals from each of the input sources in each heating zone 50. If the control console receives an input signal for the temperature of the sludge 31 in a particular heating zone, 50*a*–50*h*, in excess of a predetermined sludge temperature set point, the process control console 53 initiates an output signal to begin a reduction in the surface temperature of the heating elements 48 within that particular heating zone in a desired sequence.

If the temperature of the sludge 31 in any heating zone, 50*a*–50*h*, is below the set point, a second input parameter such as the temperature of a selected transverse beam 15 of the auger trough assemblies 16 and 18 is monitored. If the set point temperature for the selected transverse beam 15 is exceeded in a particular heating zone, 50*a*–50*h*, the process control console 53 initiates an output signal to reduce the temperature of the heating elements 48 of the heating assemblies 42 in that particular zone in a desired sequence. Similarly, if the metal temperature of the transverse beam 15 is below its set point, no temperature reduction output signals are initiated from the console and the heating element temperatures remain the same. If the metal temperature in a particular zone 50 exceeds its set point, the temperature of the heating elements 48 of the heating assemblies 42 in that particular zone are reduced. This process is repeated as the various temperature input signals in each heating zone, 50*a*–50*h*, are continuously monitored and compared to their respective temperature set points. This process continues as the sludge 31 moves through the dryer 10 from the sludge inlet chute 30 to the sludge outlet chute 40 to exit the dryer 10 in a dried condition.

In a similar manner, if the flow of sludge 31 to the dryer 10 is interrupted, the sludge flow signal switch 60 is activated and the process control console 53 initiates a reduction in the temperature of the heating elements 48 in each of the heating zones 50 in a predetermined sequence to insure that the sludge 31 remaining in the dryer 10 completes the drying process. If each of the input signals is below the respective set points, the process control console 53 will initiate an output signal to regulate the electrical power transmitted to the infrared heating assemblies 42 to maintain the surface temperature of its heating elements 48 in each particular heating zone 50 at its predetermined set point, independent from the heating element temperatures of the infrared heating assemblies 42 in the other heating zones 50.

It is thought that the apparatus and method for drying sludge and its intended advantages will be understood from the foregoing description. It is also thought to be apparent that various changes may be made in the form, construction, and arrangement of the parts thereof without departing from the spirit and scope of the invention or sacrificing all of its material advantages. The described herein is intended to be merely illustrative of the preferred embodiment of the invention.

We claim:

1. A sludge dryer for drying a quantity of sludge comprising:

a) a plurality of drying zones;

b) a plurality of infrared emitters within each of said drying zones, said emitters having temperature regulating means;

c) a means for producing a flow of said sludge through said drying zones;

d) a control means;

e) means for determining and transmitting to said control means control input signals indicating the surface temperature of said emitters within each of said drying zones;

f) means for determining and transmitting to said control means control input signals indicating the temperature of said sludge within each of said drying zones;

g) means for determining and transmitting to said control means control input signals indicating the wet bulb temperature of the air within each of said drying zones;

h) means for determining and transmitting to said control means control input signals indicating an interruption and uninterruption of said sludge flow through said dryer; and i) processor means having a predetermined set of signal set points incorporated with said control means for receiving said control input signals, comparing said control input signals to each other and to said predetermined set of signal set points and for transmitting control output signals based upon said control input signals and said predetermined set of signal set points to regulate the temperature of said infrared emitters within each of said drying zones and said means for producing a flow of sludge to control the drying of said sludge.

2. A sludge dryer for drying a quantity of sludge as recited in claim 1 wherein, said means for producing a flow of sludge through said dryer is a plurality of augers.

3. A sludge dryer for drying a quantity of sludge as recited in claim 1 wherein, said infrared emitters produce wavelengths in the range between 2.5 and 3.5 microns.

4. A sludge dryer for drying a quantity of sludge as recited in claim 3 wherein, said infrared emitters are electrically powered.

5. A sludge dryer for drying a quantity of sludge as recited in claim 3 wherein, said infrared emitters are gas powered.

6. A sludge dryer for drying a quantity of sludge as recited in claim 1 wherein, said dryer is comprised of metal components further comprising means for determining and transmitting to said control means control input signals indicating the temperature of a predetermined number of said metal components within each of said drying zones.

7. A dryer for drying sludge comprising:

a) a metal frame;

b) a plurality of metal auger troughs mounted on said frame, each of said auger troughs being divided into a plurality of drying zones, each of said auger troughs having a trough inlet end, a trough outlet end, a plurality of upper transverse supports, and a trough cover, said auger troughs forming a sludge space and an air space;

c) a plurality of augers within each of said auger troughs for moving said sludge along said auger troughs;

d) a sludge inlet chute in communication with said inlet ends of said auger troughs whereby said sludge may be introduced into said auger troughs through said trough inlet ends;

e) a sludge outlet chute in communication with said outlet ends of said auger troughs whereby said sludge may exit said dryer;

f) a plurality of infrared heat emitters for emitting radiant energy to said sludge mounted along each of said auger troughs within each of said drying zones over said augers, said emitters having means to regulate the surface temperature of said emitters;

g) a process controller for controlling said dryer and regulating said surface temperature of said emitters;

h) means for determining and transmitting control input signals to said process controller indicating the wet bulb temperature of the air within said air space within said auger troughs, said sludge temperature within said sludge space of said auger troughs, the temperature of said upper transverse supports of said auger troughs and the surface temperature of said infrared heat emitters, within each of said drying zones;

i) means for determining and transmitting a control input signal to said process controller indicating the flow of said sludge into said dryer; and j) a control means incorporated with said process controller having a predetermined set of input signal set points for receiving said heat emitter surface temperature, said sludge temperature, said air space wet bulb temperature, said of temperature of said upper transverse supports of said auger trough and said sludge flow control input signals, comparing said signals to each other and to said predetermined set of signal set points, and for transmitting output signals based upon said control input signals and said predetermined set of signal set points so as to independently regulate the temperature of said heat emitters within each of said drying zones to control the drying of said sludge as said sludge moves along said auger troughs through said dryer.

8. A sludge dryer as recited in claim 7 wherein, said infrared heat emitters produce radiant energy having wavelengths in the range between 2.5 and 3.5 microns.

* * * * *